United States Patent [19]

Higashi et al.

[11] 4,024,425

[45] May 17, 1977

[54] METAL HALIDE LAMPS

[75] Inventors: Tadatoshi Higashi; Mitsunori Yoshimoto, both of Yokohama; Mituharu Hagiwara; Toshihiko Ishigami, both of Tokyo, all of Japan

[73] Assignee: Tokyo Shibaura Electric Co., Ltd., Kawasaki, Japan

[22] Filed: Nov. 6, 1975

[21] Appl. No.: 629,216

[30] Foreign Application Priority Data

| | | |
|---|---|---|
| Nov. 11, 1974 | Japan | 49-128955 |
| June 12, 1975 | Japan | 50-70157 |
| Oct. 1, 1975 | Japan | 50-117644 |

[52] U.S. Cl. ..... 313/174; 313/178; 313/179; 313/225; 313/229

[51] Int. Cl.[2] ..... H01K 1/52

[58] Field of Search ..... 313/174, 178, 229, 225, 313/179

[56] References Cited

UNITED STATES PATENTS

| | | | |
|---|---|---|---|
| 2,116,689 | 5/1938 | Rompe | 313/225 X |
| 3,582,703 | 6/1971 | Takahashi et al. | 313/174 |
| 3,849,687 | 11/1974 | Huston | 313/179 |

*Primary Examiner*—Stanley T. Krawczewicz
*Attorney, Agent, or Firm*—Oblon, Fisher, Spivak, McClelland & Maier

[57] ABSTRACT

A metal halide lamp comprising a luminous sealed tube, a pair of electrodes housed in the luminous tube and rare gas, mercury and metal halide sealed in the luminous tube, characterized in that boron or a boron compound is sealed in the luminous sealed tube in such a manner as not to contact the surfaces of the electrodes. The metal halide lamp is advantageous in that the electrodes are prevented from corrosion and that the blackening with time of the inner wall of the luminous tube is suppressed.

9 Claims, 7 Drawing Figures

METAL HALIDE LAMPS

This invention relates to a metal halide lamp enabled to prevent the electrodes from corrosion by halogen and effective for controlling the blackening with time of the inner wall of the luminous sealed tube.

A metal halide lamp comprises a pair of electrodes housed in a luminous sealed tube and rare gas, mercury and metal halide sealed in said luminous tube. The metal halide contributes to the improvement of the color-rendering property and efficacy of the metal halide lamp, but liberates elemental halogen such as iodine, bromine and chlorine by arc discharge between the electrodes. The liberated halogen corrodes the electrodes and breaks them with time, thus rendering the lamp incapable of lighting.

In order to prevent the electrode corrosion with halogen, a method has been proposed to coat the majority of the surfaces of a pair of electrodes with a halogen-resistant compound having a high melting point. For example, Japanese Patent Application Publication No. 14701/65 discloses boron carbide or boron nitride as the halogen-resistant high melting material.

Indeed, the technique disclosed in said Publication is effective for preventing the electrode corrosion, but fails to suppress the blackening with time of the inner wall of the luminous tube. An additional difficulty involved is that the coating process of the electrode surface is troublesome.

An object of this invention is to provide at a low cost a metal halide lamp free from the electrode corrosion with halogen and low in the blackening speed with time of the inner wall of the luminous tube.

Another object is to provide a method for easily sealing in a luminous tube a minimum amount of boron required for preventing the electrode corrosion.

This invention provides a metal halide lamp comprising a luminous sealed tube, a pair of electrodes received in the luminous tube, and rare gas, mercury and metal halide sealed in the luminous tube and is featured in that elemental boron or a boron compound is sealed in the luminous tube in such a manner as not to contact the surfaces of the electrodes.

Where a compound composed of boron and a metal having a high melting point is used, it is desired that the boron content of the compound be 50 atomic percent or less.

The amount of boron or a boron compound plays a vital role in this invention and a desired amount is such that the amount of boron serving to prevent the electrode corrosion falls within the range from 0.01 to 0.43 micro gram-atom per milliliter of the inner volume of the luminous tube. In a metal halide lamp having an auxiliary electrode housed in a luminous sealed tube as a discharge starting means boron or a boron compound can be deposited on the surface of the auxiliary electrode.

This invention can be more fully understood from the following detailed description when taken in conjunction with the accompanying drawings, in which.

Figure 1:
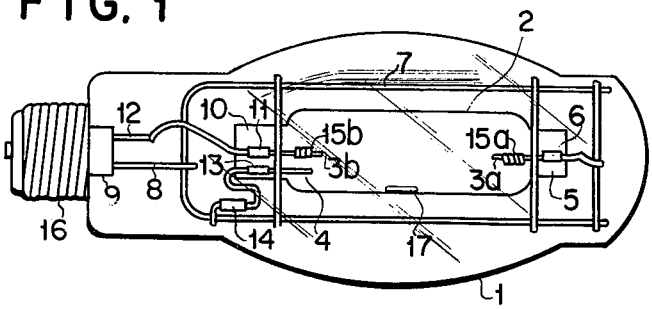
FIG. 1 is a front view of a metal halide lamp according to one embodiment of this invention.

The construction of a metal halide lamp of this invention is now explained based on FIG. 1.

A luminous sealed tube 2 made of quartz glass or a transparent alumina porcelain is housed in an outer tube 1 made of a transparent material like glass. A pair of main electrodes 3*a*, 3*b* and an auxiliary electrode 4 acting as the discharge starting means are housed in the luminous tube 2. Further, rare gas, mercury and metal halide are sealed in the luminous tube 2. At least one compound selected from the group consisting of iodides, bromides and chlorides of Sn, Na, Tl, In, Al, Dy, Sc, Sm, Cs, Ce and Tm is used as the metal halide.

The main electrode 3*a* is connected to a conductive frame 7 through a molybdenum foil 6 sealed by a pinch seal 5 the conductive frame 7 being fixed to a stem 9 through a conductive support 8. On the other hand, the main electrode 3*b* is connected to a conductive support 12 through another molybdenum foil 11 sealed by another pinch seal 10. The conductive support 12 is fixed to the stem 9.

The auxiliary electrode 4 is disposed adjacent to the main electrode 3*b* are connected to the frame 7 through a molybdenum foil 13 sealed by the pinch seal 10 and a resistor 14 of a high resistance.

Tungsten coils 15*a*, 15*b* are respectively wound around the main electrodes 3*a*, 3*b*. The conductive supports 8 and 12 are electrically connected to the outer circumference and the central projection of a cap 16, respectively.

It is necessary to seal elemental boron or a boron compound in the luminous tube 2 such that the sealed substances do not contact the surfaces of the main electrodes. A desired manner of sealing is to seal in the luminous tube elemental boron or a boron compound deposited on the surface of a high melting metal like W, Nb, Mo or Ta. A typical example is shown in FIG. 1, in which a tungsten wire 17 about 2 mm long and about 0.3 mm in diameter, covered with a layer of tungsten boride about 2 $\mu$m thick, is sealed in the luminous tube 2.

Figure 2:
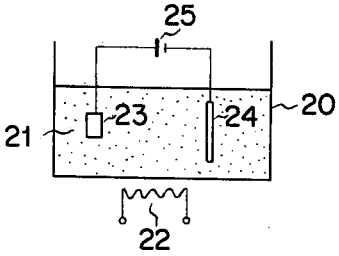
FIG. 2 illustrates a device for forming a boron compound layer on the surface of a high melting metal.

FIG. 2 shows a device for electrolytically forming a tungsten boride skin layer on a tungsten wire. Anhydrous borax ($Na_2B_4O_7$) 21 is received in an alumina vessel 20. When heated by a heater 22, the anhydrous borax 21 melts at 900° C. In the anhydrous borax 21 are immersed apart from each other a platinum anode 23 and a tungsten wire cathode 24 about 20 mm long and about 0.3 mm in diameter. D.C. voltage is applied across the anode 23 and the cathode 24 by a power source 25.

Using the device of FIG. 2, an experiment was conducted for 3 minutes with the treating temperature set at 900° C and the current density of 0.3 A/cm$^2$, obtaining a result that a tungsten boride layer about 2 $\mu$m thick was formed on the surface of the tungsten cathode 24. The tungsten boride layer consisted of $W_2B_5$ (surface region) and WB (inner portion).

The tungsten wire thus treated was further subjected to a heat treatment under vacuum for about 20 minutes at 1,500° C, with the result that almost all the $W_2B_5$ was converted to WB.

It is advisable to seal in the luminous tube 2 a tungsten wire thus covered with a WB layer and cut into a small piece about 2 mm long.

Figure 3:
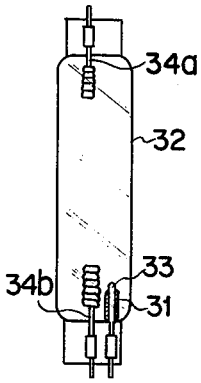
FIG. 3 is a front view of a luminous sealed tube in which elemental boron or a boron compound is deposited on the surface of an auxiliary electrode.

Elemental boron or a boron compound may also be deposited on the surface of an auxiliary electrode 33 as shown by the reference numeral 31 in FIG. 3 showing the construction of a luminous sealed tube 32. Incidentally, the reference numerals 34*a* and 34*b* denote a pair of main electrodes. It is preferred that boron or a boron compound be deposited on that portion of the auxiliary electrode 33 where the temperature does not exceed 1000° C during the lighting time of the metal halide lamp.

The effects of this invention will be more fully understood by the following examples and a control.

EXAMPLE 1 and Control

A metal halide lamp substantially equal in structure to the one shown in FIG. 1 was prepared. Namely, the luminous tube of the lamp housed a tungsten wire 2 mm long, 0.3 mm in diameter and covered with a WB layer about 2 μm thick. Likewise, another metal halide lamp was prepared in just the same structure as the one mentioned above except that a tungsten wire covered with a WB layer was not housed in the luminous tube, for the purpose of comparison. Each of the luminous tubes of these lamps had an inner volume of 3 ml and sealed therein were 15 mg of mercury, 4 mg of stannous iodide and an argon-neon mixture of 1:1 ratio at a pressure of 25 mm Hg at a room temperature.

Figure 4:
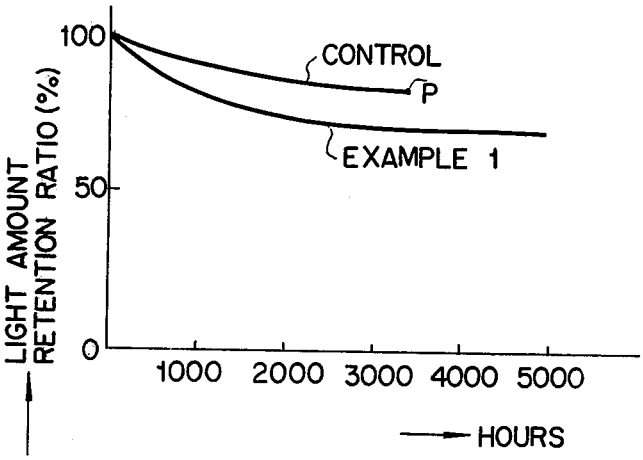
FIGS. 4 to 7 are graphs showing the effects of this invention.

These two lamps were subjected to lighting tests each at an input power of 125W, obtaining a graph of FIG. 4. Plotted in the ordinate of the graph is the light amount retention ratio (%), i.e., the ratio of the amount of light at an optional time to the light amount at the initial period.

As seen from the graph, the electrodes of the metal halide lamp according to this invention were not broken even when the lighting time reached 5000 hours. Further, the light amount retention ratio was as high as about 75% even after the lighting time exceeded 4000 hours. Incidentally, a high light amount retention ratio indicates a slow blackening with time of the inner wall of the luminous tube.

The control case was advantageous over Example, in light amount retention ratio, but the electrodes were broken when the lighting time reached 3500 hours as shown by *p*.

EXAMPLE 2

A metal halide lamp prepared was substantially equal to the one prepared in Example 1 except that a tungsten wire sealed in the luminous tube was covered with a $W_2B_5$ layer in stead of a WB layer.

Figure 5:
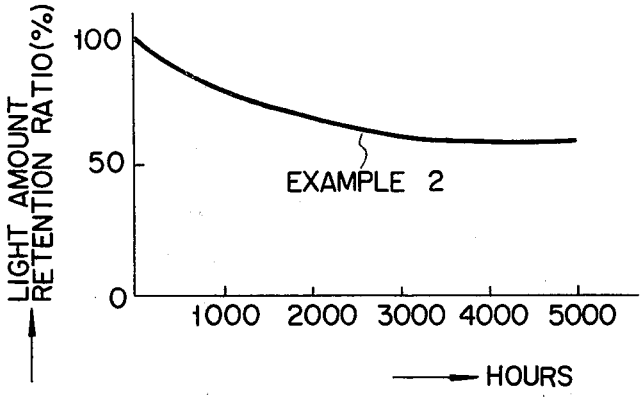

A lighting test was also conducted in just the same manner as in Example 1, obtaining a graph of FIG. 5. In this case, the electrodes were not broken even after 5000 hours of lighting, but the light amount retention ratio lowered to about 60% at the time of 5000 hours of lighting.

EXAMPLE 3

A lighting test as in Example 1 was applied to a metal halide lamp prepared in just the same manner as in Example 1 except that a tungsten wire sealed was covered with a layer of $W_2B$, namely, the boron content of the layer was less than 50 atomic percent.

Figure 6:
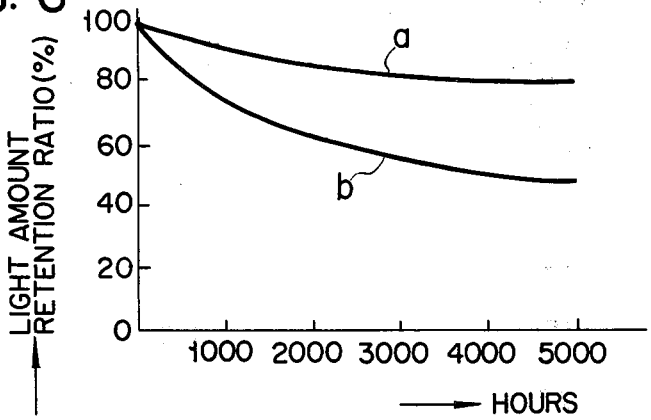

Curve (*a*) of FIG. 6 shows the result. It is seen that the electrodes were not broken after 5000 hours of lighting. On the other hand, the light amount retention ratio was as high as about 80% even after the lighting time exceeded 4000 hours. Incidentally, curve (*b*) shown represents the result of Example 4 mentioned below.

EXAMPLE 4

A lighting test was conducted in just the same manner as in Example 3 except that a tungsten wire 2 mm long, 0.3 mm in diameter and covered with elemental boron layer 2 μm thick was sealed in the luminous tube. The curve (*b*) of FIG. 6 shows the result as mentioned previously. It is seen that the electrodes were not broken after 5000 hours of lighting, but the light amount retention ratio at that time was about 50%.

EXAMPLE 5

Figure 7:
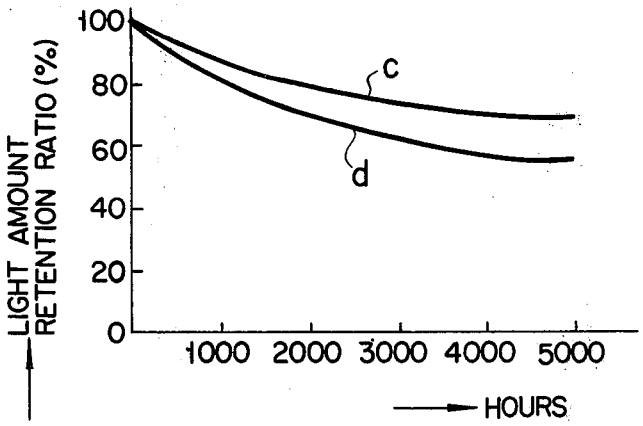

A lighting test was conducted in just the same manner as in Example 3 except that a WB layer 2 μm thick was formed on the surface of a tungsten auxiliary electrode 5 mm long and 0.5 mm in diameter. Curve (*c*) of FIG. 7 shows the result. It is seen that the light amount retention ratio after 4000 hours of lighting was about 70% and the electrodes were not broken at the time of 5000 hours of lighting Curve (*d*) shown represents the result of Example 6 mentioned below.

EXAMPLE 6

A lighting test was conducted in just the same manner as in Example 5 except that a layer of $W_2B_5$ was substituted for the layer of WB, the result being shown by curve (*d*) of FIG. 7. It is seen that the light amount retention ratio after 4000 hours of lighting was about 60% and the electrodes were not broken when the lighting time reached 5000 hours.

EXAMPLE 7

Sixteen metal halide layers were prepared, each constructed substantially equal to that used in Example 1.

The inner diameter of the luminous tube was 20 mm, the inner volume thereof about 24 ml and the paired main electrodes 60 mm apart. A neon-argon mixed gas the mixing ratio being 1:1, was sealed in the luminous tube at a pressure of 30 mm Hg at a room temperature. Further, Hg, $SnBr_2$ and $SnI_2$ were sealed in the luminous tube in the amount of 2.1 mg, 0.4 mg and 0.4 mg, respectively, per ml of the inner volume of the luminous tube.

Also prepared were tungsten wires each about 1.5 mm long, 0.3 mm in diameter and covered with a WB layer about 5 μm thick, said tungsten wires being hereinafter referred to as the "test pieces".

The 16 lamps were classified into four groups each consisting of four lamps. The test piece was not sealed at all in the luminous tube fitted to the metal halide lamps of a first group, herein called "Sample 1". Samples 2, 3 and 4 similarly termed herein involved one, three and six test pieces, respectively.

Lighting tests were conducted on the Samples 1 to 4 each at an input power of 400 W, obtaining the results as shown in Table 1.

Table 1

| Sample | Number of test pieces | Time for having electrode broken (average) | Light amount retention ratio at 2,000 hours lighting (average) |
|---|---|---|---|
| 1 | 0 | 5,100 hours | 101 % |
| 2 | 1 | 7,300 hours | 98 % |
| 3 | 3 | more than 10,000 | 91 % |
| 4 | 6 | more than 10,000 hours | 81 % |

After 10,000 hours of lighting, the test pieces were taken out of the Sample 3 and subjected to chemical analysis, with the result that boron consumption was recognized in an amount corresponding to that contained in a tungsten boride layer having a thickness of 2 μm. This indicates that the boron contained in the WB layer in the surface region of 2 μm in thickness served to prevent the electrode corrosion.

Now, let it be assumed that the WB layer had a specific gravity of 16.3. It follows that each test piece supplied boron in the amount of 0.24 micro gram-atom. Since the inner volume of the luminous tube was 24 ml, this means that each test piece supplied boron in the amount of 0.01 micro gram ($10^{-8}$ gram)-atom per ml of the inner volume of the luminous tube.

Table 1 teaches that the presence of boron in an amount of 0.01 micro gram-atom or more per ml of the inner volume of the luminous tube produces practically satisfactory effects in preventing the electrode corrosion and blackening with time of the inner wall of the luminous tube.

EXAMPLE 8

Sixteen metal halide lamps were prepared, each constructed substantially equal to that used in Example 7 except that the inner diameter of the luminous tube was 12 mm, the paired main electrodes 27 mm apart, the inner volume of the luminous tube 3 ml and, Hg and $SnI_2$ were sealed in the luminous tube in the amount of 5 mg and 1.2 mg, respectively, per ml of the inner volume of the luminous tube. WB-deposited tungsten wires used as test pieces were also prepared in just the same manner as in Example 7.

The 16 lamps were classified into four groups each consisting of four lamps, these groups being called herein Samples 5, 6, 7 and 8 respectively. The test piece was not sealed at all in Sample 5, and 1, 2, 5 test pieces were sealed in Samples 6, 7, 8, respectively.

Lighting tests were also conducted on Samples 5 to 8, each at an input power of 125 W. Table 2 shows the results.

Table 2

| Sample | Number of test pieces | Time for having electrode broken (average) | Light amount retention ratio at 2,000 hours lighting (average) |
|---|---|---|---|
| 5 | 0 | 3,800 hours | 100 % |
| 6 | 1 | more than 7,000 hours | 84 % |
| 7 | 2 | more than 7,000 hours | 65 % |
| 8 | 5 | more than 7,000 hours | 43 % |

In Sample 8 where five test pieces were sealed in the luminous tube, the light amount retention ratio after 2,000 hours of lighting was below 50%, indicating that a too much amount of boron present in the luminous tube should be avoided.

A calculation shows that in Sample 8 boron in the amount of 0.43 micro gram-atom per ml of the inner volume of the luminous tube was supplied by the five test pieces. An obvious conclusion is that it is preferred to determine the amount of sealed boron or a boron compound such that the boron serving to prevent the electrode corrosion should not exceed 0.43 micro gram-atom per ml of the inner volume of the luminous tube.

EXAMPLE 9

Eight metal halide lamps were prepared, each constructed substantially equal to that used in Example 8 except that the inner diameter of the luminous tube was 18 mm, the paired main electrodes 45 mm apart, the inner volume of the luminous tube 16 ml, and Hg, $SnCl_2$, and $SnI_2$ were sealed in the luminous tube in the amount of 2.1 mg, 0.3 mg, and 0.45 mg, respectively, per ml of the inner volume of the luminous tube.

These eight lamps were classified into two groups each consisting of four lamps, said groups being called herein Samples 9 and 10 respectively. Two test pieces prepared just as in Example 8 were sealed in Sample 10. On the other hand, the test piece was not sealed at all in Sample 9.

Lighting tests were conducted on these Samples each at an input power of 400 W, obtaining the results shown in Table 3.

Table 3

| | Number of test pieces | Time for having electrode broken (average) |
|---|---|---|
| Sample 9 | 0 | 950 hours |
| Sample 10 | 2 | more than 2,000 hours |

In this invention, the corrosion of the electrode base with halogen is prevented by the action of boron. It is supposed that the boron halides-forming reactions precede the tungsten halides-forming reactions at low temperature portions within the luminous tube, thereby to present the effects of this invention.

This invention also permits sealing in a luminous sealed tube a boron halide having a high vapor pressure such as boron iodide, boron bromide or boron chloride, in a gaseous phase.

What we claim is:

1. A metal halide lamp comprising a luminous sealed tube, a pair of main electrodes disposed in said luminous sealed tube, rare gas, mercury and metal halide sealed in said luminous sealed tube, and a material selected from the group consisting of boron and a boron compound sealed in said luminous sealed tube and so disposed as not to contact any exposed surface of said pair of main electrodes whereby corrosion by halogen of the exposed surfaces of said pair of main electrodes is prevented.

2. The metal halide lamp of claim 1, wherein the material is selected from the group consisting of boron and a boron compound is provided in the luminous sealed tube in the form of a deposit on a metal having a high melting point.

3. The metal halide lamp of claim 2, wherein the high melting point metal is selected from the group consisting of tungsten, niobium, molybdenum and tantalum.

4. The metal halide lamp of claim 1, wherein the boron compound is a compound of boron and a metal having a high melting point.

5. The metal halide lamp of claim 4, wherein the boron compound is tungsten boride.

6. The metal halide lamp of claim 4, wherein the boron content of the boron compound is not more than 50 atomic percent.

7. The metal halide lamp of claim 1, wherein the amount of the material selected from the group consisting of boron and a boron compound is within the range of 0.01 to 0.43 microgram-atom per milliliter of the inner volume of the luminous sealed tube.

8. The metal halide lamp of claim 1, wherein the material selected from the group consisting of boron and a boron compound is provided in the luminous sealed tube as a deposit on the exposed surface of an auxiliary electrode disposed in said luminous tube in addition to the pair of main electrodes.

9. The metal halide lamp of claim 1, wherein the boron compound is sealed in said luminous glass tube in a gaseous state so as not to deposit on any exposed surface of said pair of main electrodes and comprises a boron halide having a high vapor pressure selected from the group consisting of boron iodide, boron bromide and boron chloride.

* * * * *